US008360554B2

(12) United States Patent
Allaway

(10) Patent No.: US 8,360,554 B2
(45) Date of Patent: Jan. 29, 2013

(54) MODULAR ENCODER

(75) Inventor: David Scott Allaway, Portland, OR (US)

(73) Assignee: Xerox Corporation, Norwalk, CT (US)

( * ) Notice: Subject to any disclaimer, the term of this patent is extended or adjusted under 35 U.S.C. 154(b) by 1593 days.

(21) Appl. No.: 11/880,023

(22) Filed: Jul. 19, 2007

(65) Prior Publication Data

US 2009/0021557 A1 Jan. 22, 2009

(51) Int. Cl.
*B41J 23/00* (2006.01)

(52) U.S. Cl. ..... 347/38

(58) Field of Classification Search ..... 347/38
See application file for complete search history.

(56) References Cited

U.S. PATENT DOCUMENTS 5,241,525 A 8/1993 Taylor
5,563,591 A 10/1996 Jacobs et al.
5,708,496 A 1/1998 Barnett et al.
5,859,425 A 1/1999 Mleinek et al.
5,933,171 A * 8/1999 Komatsu ..... 347/75
5,984,564 A 11/1999 Mitterreiter
6,025,588 A 2/2000 Hsu
6,107,621 A 8/2000 Imai et al.
6,462,442 B1 10/2002 Braun et al.
6,483,105 B2 11/2002 McAllister et al.
6,552,464 B1 4/2003 Rahbar et al.
6,600,151 B2 7/2003 Chapman et al.
6,608,300 B2 8/2003 Meschko
6,624,407 B1 9/2003 Aboonasry et al.
6,692,701 B2 2/2004 Cleveland
6,960,758 B2 11/2005 Tenca et al.
6,966,623 B2 11/2005 Fo et al.
7,026,734 B2 4/2006 Braun
7,065,966 B2 6/2006 Yamada et al.
7,205,530 B2 * 4/2007 Jones ..... 250/231.13

* cited by examiner

*Primary Examiner* — Kevin S Wood
(74) *Attorney, Agent, or Firm* — Maginot, Moore & Beck, LLP

(57) ABSTRACT

A modular encoder has been developed that can be mounted to a motor shaft without requiring time consuming alignment or special tools. The encoder includes a base having an annular opening, the base including a plurality of resilient arms surrounding the annular opening with each arm having a terminal end that extends into the annular opening, and a hub having a horizontal flange with a top and a bottom surface and a generally vertical wall extending from the bottom surface of the horizontal flange, the wall is configured to fit within the annular opening of the base and is circumscribed with a groove for receiving the terminal ends of the resilient arms to secure the hub to the base and enable rotation of the hub within the annular opening of the base as the terminal ends of the resilient arms slide within the groove.

15 Claims, 6 Drawing Sheets

MODULAR ENCODER

TECHNICAL FIELD

The encoder described below generally relates to angular position encoders used having rotary print drums and the like. More specifically, the encoder relates to the structure of encoders for mounting the encoder to a rotating shaft and for assembling encoders.

BACKGROUND

Modern printers use a variety of inks to generate images from data. These inks may include liquid ink, dry ink, also known as toner, and solid ink. So-called "solid ink" refers to ink that is loaded into a printer as a solid, which is typically in stick or pellet form. The solid ink is melted within the printer to produce liquid ink that is supplied to a print head for ejection onto media or an intermediate member to generate a printed image from image data. These solid ink printers typically provide more vibrant color images than toner or liquid ink jet printers.

A schematic diagram for a typical solid ink imaging device is illustrated in FIG. 1. The solid ink imaging device, hereafter simply referred to as a printer 108, has an ink loader 110 that receives and stages solid ink sticks. The ink sticks progress through a feed channel of the loader 110 until they reach an ink melt unit 120. The ink melt unit 120 heats the portion of an ink stick impinging on the ink melt unit 120 to a temperature at which the ink stick melts. The liquefied ink is supplied to one or more print heads 130 by gravity, pump action, or both. Printer controller 180 uses the image data to be reproduced to control the print heads 130 and eject ink onto a rotating print drum or image receiving member 140 as image pixels for a printed image. Media 170, such as paper or other recording substrates, are fed from a sheet feeder 160 to a position where the image on the drum 140 can be transferred to the media. To facilitate the image transfer process, the media 170 are fed into a nip between the transfer, sometimes called transfix, roller 150 and the rotating print drum 140. In the nip, the transfix roller 150 presses the media 170 against the print drum 140. Offset printing refers to a process, such as the one just described, of generating an ink or toner image on an intermediate member and then transferring the image onto some recording media or another member.

Generation of images on the print drum may require several revolutions of the drum. In order to eject the ink in the proper position within a partially formed image, the precise position of the drum must be monitored. Additionally, the controller synchronizing the finished image with the feeding of a media sheet into a nip with the print drum for the transfer of the image from the drum to the media sheet needs accurate information regarding the position of the drum's surface as it rotates about its center. The printer 100, therefore, includes a rotary encoder that generates an electrical signal corresponding to the angular position of the rotating drum 140.

Rotary encoders may use optical, magnetic, or inductive sensing to generate a position signal. Optical encoders include a light source and sensor that are mounted on opposite sides of a flat disk. The disk is coupled to the rotating shaft of a print drum so the disk rotates with the shaft and drum. A plurality of spaced apart marks is located within a circumferential slot on the disk and this slot is positioned between the light source and light sensor. As the disk rotates, the light from the light source is interrupted by the marks. Consequently, the light sensor detects light in an on/off pattern corresponding to the marks on the disk as they pass between the light and its sensor. The resulting optical digital signal is converted by the sensor into an electrical digital signal. This signal may be used by a controller in a known manner for coordinating control of the print heads with an image on the print drum and for transferring an image from the print drum to a sheet of media. The disk bearing the series of spaced apart marks is sometimes known as a code wheel.

Optical encoders fall into two broad categories. The first category includes encoders that are assembled with a shaft extending from the center of the code wheel through the body or housing of the encoder. This type of encoder is delivered as a complete package for attachment via a coupler to the shaft about which the print drum rotates. The assembly of the encoder at the manufacturer's facility enables the code wheel, optical sensor, and light source to aligned and spaced from one another at the factory. The second category of encoders, sometimes referred to as modular encoders, do not have a shaft section built into the body or housing of the encoder. Instead, the code wheel typically has an annular opening at its center and the center of the housing so a collar to which the code wheel is mounted can be coupled to the shaft of the motor. The coupling may be accomplished using a set screw or the like. Various structures have been developed for axial and radial alignment of the code wheel so the code wheel is centered on the shaft and appropriate tolerances are provided for the placement of the code wheel within the gap between the light source and sensor of the encoder. These structures and tools require time during the installation of the encoder on the motor shaft for the alignment of the encoder components that are critical to accurate signal generation. Should the motor later require maintenance, the encoder must be removed and the alignment procedure repeated before returning the motor to service.

SUMMARY

In order to facilitate installation and service of encoders in printers, a modular encoder has been developed that can be mounted to a motor shaft without requiring time consuming alignment or special tools. The encoder includes a base having an annular opening, the base including a plurality of resilient arms surrounding the annular opening with each arm having a terminal end that extends into the annular opening, and a hub having a horizontal flange with a top and a bottom surface and a generally vertical wall extending from the bottom surface of the horizontal flange, the wall is configured to fit within the annular opening of the base and is circumscribed with a groove for receiving the terminal ends of the resilient arms to secure the hub to the base and enable rotation of the hub within the annular opening of the base as the terminal ends of the resilient arms slide within the groove.

BRIEF DESCRIPTION OF THE DRAWINGS

Features of the present invention will become apparent to those skilled in the art from the following description with reference to the drawings, in which.

DETAILED DESCRIPTION

The term "printer" refers, for example, to reproduction devices in general, such as printers, facsimile machines, copiers, and related multi-function products. While the specification focuses on a system that rotates the transfix roller in solid ink printers, the system may be used with any printer that uses a belt or roller to assist in transferring the image to media.

Figure 1:
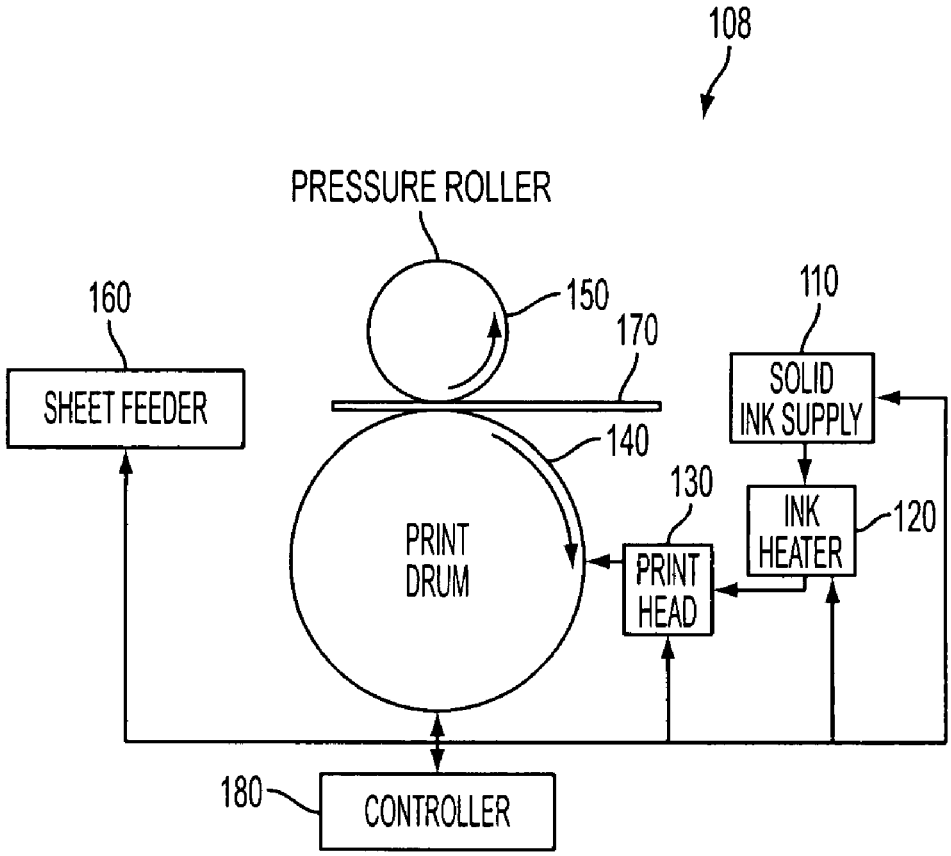
FIG. 1 PRIOR ART
FIG. 1 is a general schematic diagram of a printer having a print drum on which images are formed by a print head ejecting ink onto the print drum.
Figure 2:
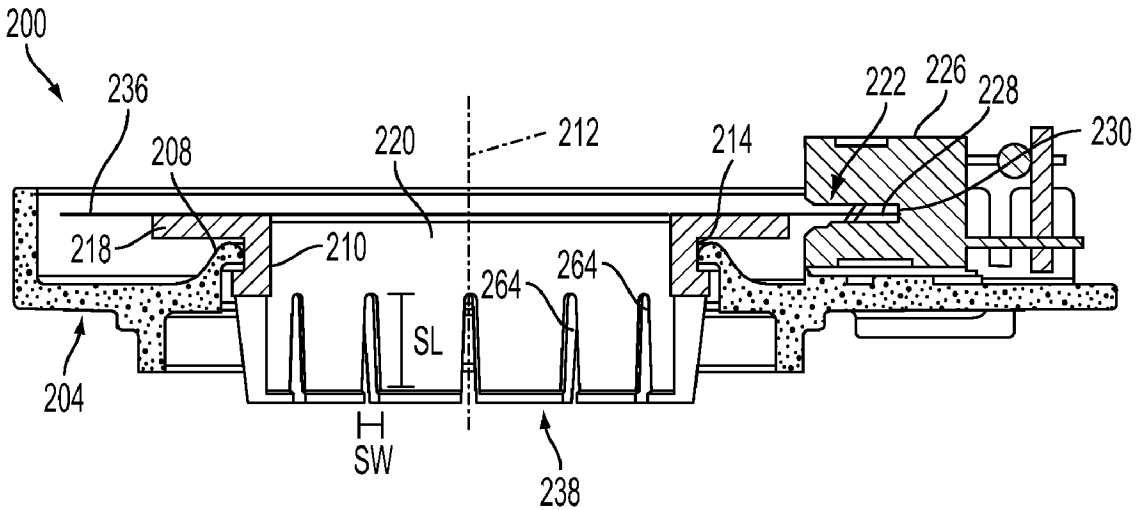
FIG. 2 is a cross sectional view of the hub, base and code wheel of a modular encoder 200

FIG. 2 depicts one embodiment of a modular encoder 200 having a base and hub that accurately position a code wheel within a sensor unit for generation of an electrical signal that corresponds with the angular position and speed of a shaft to which the hub is mounted. The encoder 200 includes a base 204 and a hub 220. The base 204 has a mounting ring 208 that defines an annular opening in the floor of the base 204. While the embodiment shown in FIG. 2 uses a solid ring to define the annular opening, other structures may be used to define the annular opening. For example, a plurality of resilient arms configured to conform to the cross-sectional view of the ring 208 shown in FIG. 2 may be used to define the annular opening in an alternative embodiment. The annular opening has a longitudinal axis 212 as shown in FIG. 2.

The hub 220 of the encoder 200, as shown in FIG. 2, has a vertical wall 210 in which a groove 214 has been circumscribed. The mounting ring 208 or other structure defining the annular opening in the floor of the base 204 is received within the groove 214 to secure the hub 220 to the base 204. The mounting ring 208 is sized and shaped so the hub 220 can be inserted into the annular opening as the external surface of wall 210 urges the mounting ring 208 away from the opening until the groove 214 is opposite the mounting ring 208. The ring or other resilient structure rebounds to be received within the groove to secure the hub to the base. This type of fit is sometimes called a snap fit.

Also located in the vertical wall 210 is a plurality of axial slits 264. The slits 264 enable the central bore 238 within the hub 220 to expand so a print drum shaft can more easily slide through the central bore. Once the hub 220 is in proper position on the shaft, the slits allow the wall 210 to constrict slightly and grip the shaft. Thereafter, rotating the print drum shaft also rotates the hub on the mounting ring. The slits are, preferably, equally spaced from one another and the number of slits may be, for example, 4, 6, 8, 10, or as shown in FIG. 2, 12 equally spaced apart axial slits 264. The axial slits 264 may have a width SW and a length SL, which are chosen to enable the hub to be mounted to a print drum shaft with a frictional fit sufficient to grip the shaft as it turns during operation of the printer. The slot width SW may be greater at the bottom of a slit than it is nearer the top of a slit.

The vertical wall 210 also includes a flange 218 that extends perpendicularly from the top of the wall. In FIG. 2, the flange 218 extends from an upper juncture of the groove 214 with the wall 210, although such a structural arrangement is not required. A code wheel 236 is mounted to the top surface of the flange 218. The location of the groove on the external surface of the wall 210 as well as the height of the groove 214 and the height of the mounting ring portion that is received in the groove 214 secure the hub 220 so it rotates within the annular opening. Additionally, these components cooperate to keep the top surface of the flange 218 and the code wheel 236 within a vertical tolerance that corresponds to a sensor slot 222 in a sensor unit 226 mounted to the floor of the base 204 as shown in FIG. 2. By appropriately locating the groove 214 in the wall 210 and configuring the size of the groove and the mounting ring 208, vertical displacement of the hub 220 is controlled for proper operation with the sensor unit 226. By controlling the dimensions and positions of the groove 214, the mounting ring 208, and the code wheel 236, the snap fitting hub 220 is positioned so properly mounting the code wheel 236 to the flange 218 enables the code wheel to be read by the sensor unit 226 when it is mounted to the base. That is, the location of the groove 214 in the wall 210 positions the code wheel mounted on the horizontal flange at a height above the base that corresponds with the slot in the sensor unit 226 so the code wheel rotates within the slot of the sensor unit.

The code wheel 236 and the sensor unit 226 cooperate to generate an electrical signal corresponding to the rotation of the hub 220. For example, the code wheel 236 may include a slot having a masking pattern 228 located in the slot. Such code wheels are well-known in the industry. The code wheel 236 is mounted to the flange 218 so the code wheel is centered about the longitudinal axis of the hub 220. The slot and masking pattern 228 are located in the outboard portion 230 of the code wheel 236 that rotates within the slot 222 of the sensor unit 226. Included within the sensor unit 226 is a light source that directs light across the slot and a light sensor that receives light from the light source after the light has traversed the slot. The masking pattern in the code wheel selectively blocks the light so the light sensor detects light in an on/off manner. The light sensor generates an electrical signal that corresponds to the alternating light signal being received by the light sensor. Thus, the electrical signal corresponds to the rotation of the code wheel mounted to the hub. The masking pattern is configured so the optical signal provides information regarding the angular position and speed of the hub and the shaft to which it is mounted as they rotate.

The electrical signal generated by the sensor unit 226 in response to the optical signal may be provided to a controller for synchronizing movement of a transfer roller with the print drum, the ejection of ink by the print head onto the print drum, or the feeding of media into the nip formed between the transfer roller and the print drum. While the sensor unit 226 has been described as an optical sensor, other types of rotational movement sensors may be used. For example, the sensor unit 226 may be an inductive type sensor that detects the selective induction of a current in a conductor arising from an alternating pattern of magnetized areas on the code wheel passing through the slot 222.

Figure 3:
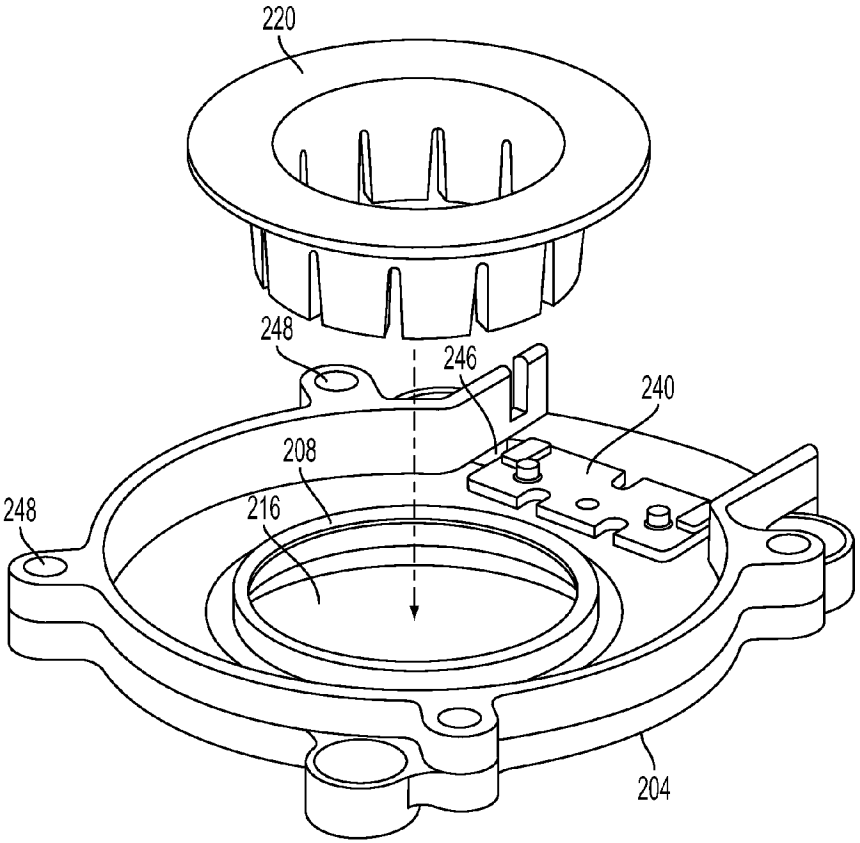
FIG. 3 is an exploded perspective view of a base and a hub of a modular encoder shown in FIG. 2 depicting the assembly of the hub to the base.

Construction of the hub and base as described above enables simple assembly of the modular encoder 200. As shown in FIG. 3, the hub 220 is pushed into the annular opening 216 to snap fit the hub onto the mounting ring 208. The dimensions of the mounting ring 208, hub 220, and the groove 214 centrally locate the hub within the annular opening 216 and limit the horizontal and vertical travel of the hub within the annular opening. As shown in FIG. 3, a mounting pad 240 for the sensor unit 226 is located on the base 204. Additionally, recessed areas 246 accommodate a spring clip (not shown), which retains the sensor unit 226 in the base. Other mounting pad configurations may be used for sensor units having geometrical configurations different than the one shown in the figures. Base 204 also includes cover mounting holes 248 for installing a cover over the encoder as discussed in more detail below.

Figure 4:
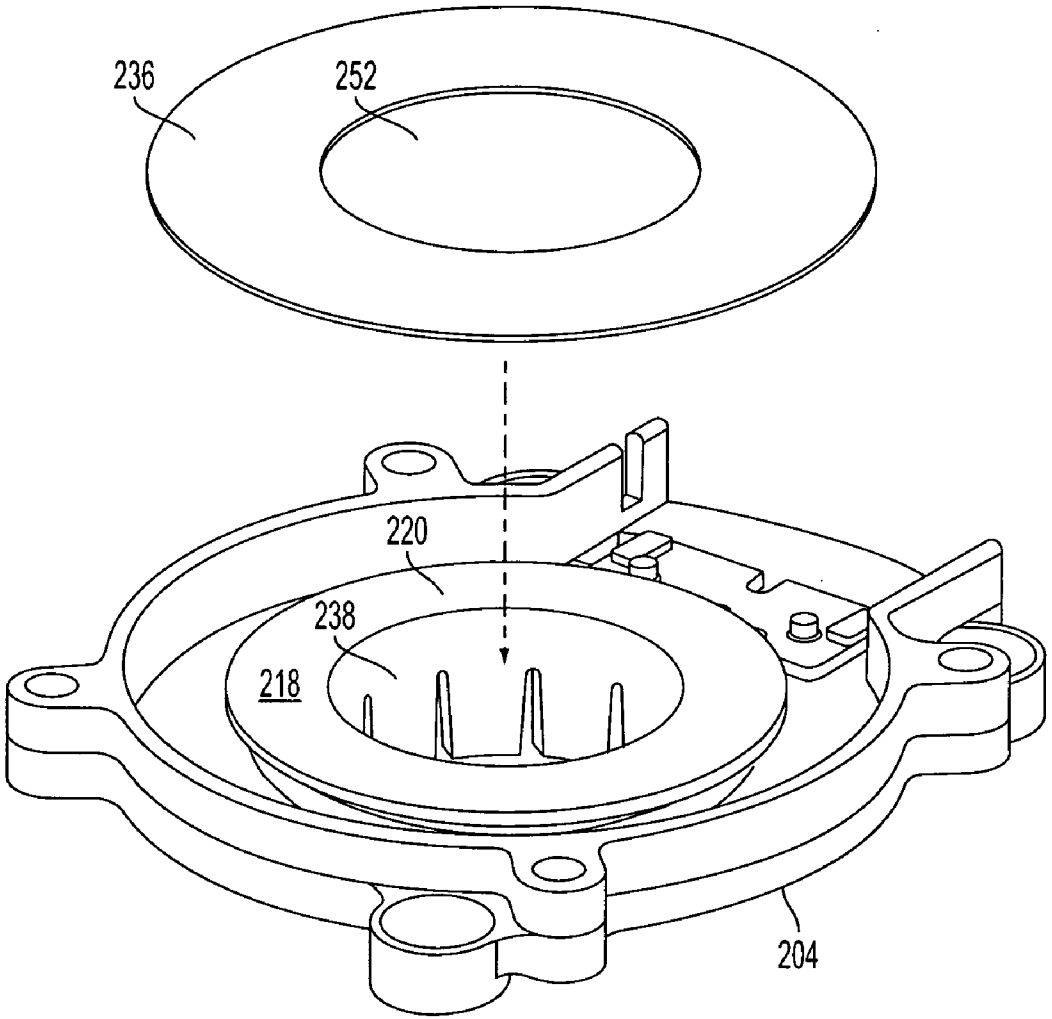
FIG. 4 is a partial perspective view of a code wheel being mounted to the hub of FIG. 3.

After the hub has been installed, a code wheel 236 having a mask pattern (not depicted) is mounted on the top surface of the hub flange 218 as shown in FIG. 4. The code wheel 236 may be mounted to the hub flange by adhesive applied to the surface of the flange 218, the underside of code wheel 236, or to both surfaces. Preferably, the central bore 238 of the hub 220 is sized to correspond to the central opening 252 of the code wheel 236 so the code wheel may be properly aligned for mounting to the hub by making the circumference of the bore 238 flush with the circumference of opening 252, although other alignment methods may be used.

Figure 5:
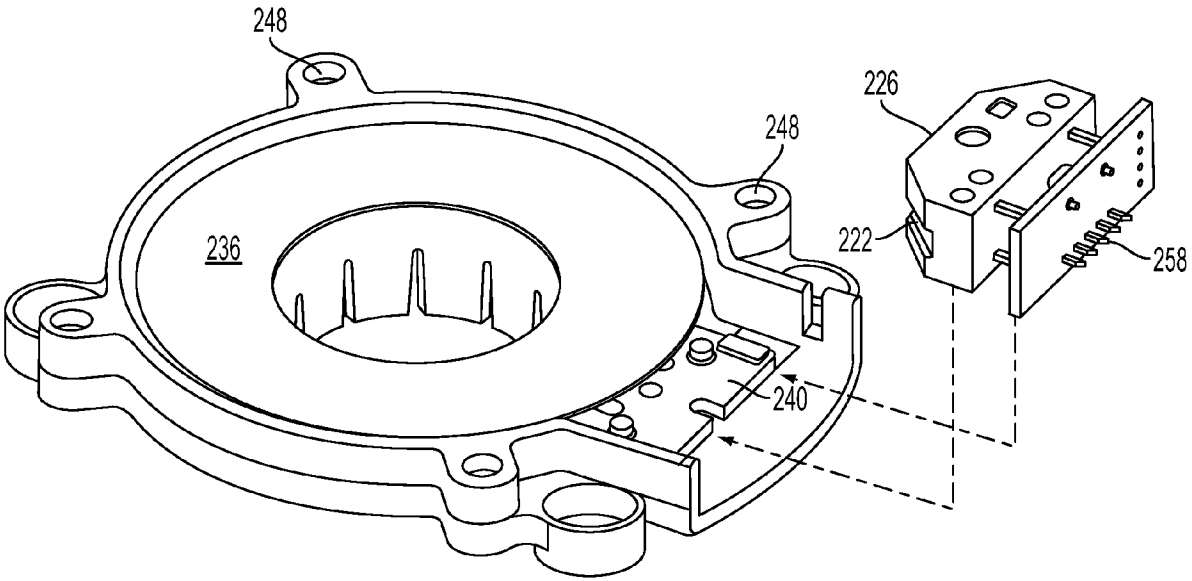
FIG. 5 is a partial perspective view of a sensor unit being mounted to the base of the encoder for detection of a masking pattern on the code wheel shown in FIG. 4.

After the code wheel 236 has been mounted to the hub 220 and the adhesive has sufficiently cured that the code wheel position is not disturbed by handling, the sensor unit 226 may be installed. As shown in FIG. 5, the sensor unit 226 is slipped into position on the pad 240 and a spring clip (not shown) is installed to mount the sensor unit 226 on the pad 240. Also, the end of the code wheel 236 is positioned within the slot 222 of the sensor unit 226. The hub may be rotated to verify smooth rotation of the code wheel within the slot 222 of the sensor unit 226. Electrical pins 258 provide electrical power to the sensor unit 226 and couple the electrical signal generated by the sensor unit to a controller.

Figure 6:
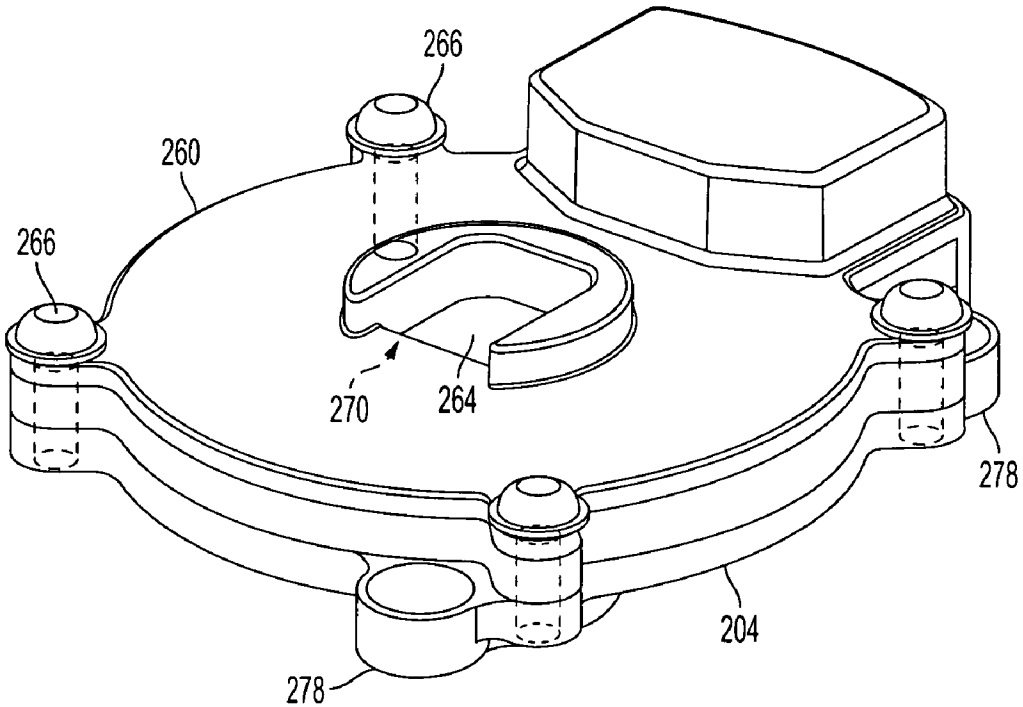
FIG. 6 is a perspective view of the modular encoder with a cover installed on the encoder.

To protect the sensor unit 226 and the code wheel 236 from paper debris and other particulate in the air surrounding the encoder 200, a cover 260 is installed to the base 204. As shown in FIG. 6, the cover 260 mates with the base 204 and fasteners 266 may be used to secure the cover 260 to the base 204. The fasteners 266 are received within openings in the cover 260 that are aligned with holes 248 in the base 204. The holes 248 may be threaded for receiving threads on the fasteners 266. Alternatively, the holes may be smooth and nuts may be used to receive the ends of the fasteners and secure the cover to the base or the holes may be smooth and self-tapping screws used to secure the cover. The cover 260 also includes angular orientation features 270 formed about the central opening 272. These features are provided to orient and retain a drum heater (not shown). After an encoder is pushed onto a print drum shaft so the axial slits 264 of the hub 220 grip the shaft, mounting holes 278 may be aligned with threaded bores on a printer frame or other structure. Fasteners may be placed into the aligned holes to secure the encoder to the printer.

Variations and modifications of the present invention are possible, given the above description. However, all variations and modifications which are obvious to those skilled n the art to which the present invention pertains are considered to be within the scope of the protection granted by this Letters Patent.

What is claimed is:

1. An encoder comprising:

a base having an annular opening, the base including a plurality of resilient arms surrounding the annular opening with each arm having a terminal end that extends into the annular opening, the resilient arms being joined together to form a mounting ring;

a hub including a central bore configured to accept a shaft, the hub having a horizontal flange with a top and a bottom surface and a generally vertical wall extending from the bottom surface of the horizontal flange, the generally vertical wall being configured to fit within the annular opening of the base and being circumscribed with a groove to receive the mounting ring formed by the resilient arms for securing the hub to the base and enabling rotation of the hub within the annular opening of the base as the mounting ring formed by the resilient arms slide within the groove; and a code wheel having a masked pattern arranged in a circular track, the code wheel being mounted to the top surface of the horizontal flange and centered about the central bore in the hub to enable the code wheel to rotate with the shaft within the central bore.

2. The encoder of claim 1, the central bore in the hub being tapered for frictional gripping of shaft within the central bore.

3. The encoder of claim 2, the wall of the hub having slits formed in the generally vertical wall for resilient gripping of a shaft within the central bore.

4. The encoder of claim 3 further comprising:

a sensor unit having a slot, the sensor unit being mounted to the base so the masking pattern rotates through the slot of the sensor unit as the code wheel rotates.

5. The encoder of claim 4, the groove being located on the generally vertical wall to position the code wheel at a height from the base that corresponds with the slot of the sensor unit.

6. The encoder of claim 5, the sensor unit further comprising:

a light source oriented to direct light across the slot of the sensor unit; and a light sensor oriented to receive light from the light source after the light has traversed the slot in the sensor unit, the light sensor generating an electrical signal corresponding to the masking pattern selectively passing light from the light source to the light sensor as the code wheel rotates through the slot of the sensor unit.

7. The encoder of claim 4 further comprising:

a cover that mates with the base to enclose the hub, code wheel, and sensor unit and form a module for installation in a printer.

8. An encoder comprising:

a base having a floor with an annular opening, the base including a mounting ring surrounding the annular opening and being vertically displaced from the floor;

a hub having an external wall that tapers from a top to a bottom and a substantially straight internal wall surrounding a central bore, the tapered external wall of the hub being configured to fit within the annular opening of the floor and being circumscribed with a groove, the external wall having a flange at the top of the external wall that extends substantially perpendicularly from the external wall with the groove being positioned on the external wall so the flange extends from an upper juncture of the groove and the external wall, the mounting ring being configured to enable the hub to be secured to the base and enable rotation of the hub within the annular opening of the base as the mounting ring slides within the groove; and a code wheel having a masking pattern arranged in a circular track, the code wheel being mounted to the top of the external wall and centered about the central bore in the hub to enable the code wheel to rotate with a shaft frictionally held within the central bore.

9. The encoder of claim 8, the hub having slits formed through the external wall and the internal wall for resilient gripping of a shaft within the central bore.

10. The encoder of claim 9 further comprising:

a sensor unit having a slot, the sensor unit being mounted to the base so the masking pattern rotates through the slot of the sensor unit as the code wheel rotates.

11. The encoder of claim 10, the sensor unit further comprising:

a light source oriented to direct light across the slot of the sensor unit; and a light sensor oriented to receive light from the light source after the light has traversed the slot in the sensor unit, the light sensor generating an electrical signal corresponding to the masking pattern selectively passing light from the light source to the light sensor as the code wheel rotates through the slot of the sensor unit.

12. The encoder of claim 10 further comprising:

a cover that mates with the base to enclose the hub, code wheel, and sensor unit and form a module for installation in a printer.

13. A printer for forming an image on media, said printer comprising:

a frame;

a print drum secured to the frame for rotation about a longitudinal axis of the print drum;

a print head for ejecting ink onto the print drum to form an image on the print drum;

a transfer roller for moving into and out of engagement with the print drum to form a nip between the transfer roller and the print drum to transfer an image on the print drum to media fed into the nip formed between the transfer roller and the print drum;

a feeder for advancing media into the nip;

a controller for synchronizing the movement of the transfer roller with the print drum, the ejection of ink by the print head onto the print drum, and the feeding of media into the nip formed between the transfer roller and the print drum; and a rotary encoder for generating an electrical signal corresponding to angular position and speed of the print drum, the encoder comprising:

a base having a floor with an annular opening, the base including a mounting ring surrounding the annular opening and being vertically displaced from the floor; and a hub comprising:

an external wall that tapers from a top to a bottom and a substantially straight internal wall surrounding a central bore, the tapered external wall of the hub being configured to fit within the annular opening of the floor and being circumscribed with a groove that receives the mounting ring to secure the hub to the base and enable rotation of the hub within the annular opening of the base as the mounting ring slides within the groove;

a flange at the top of the external wall that extends substantially perpendicularly from the external wall with the groove being positioned on the external wall so the flange extends from an upper juncture of the groove and the external wall; and a code wheel having a masking pattern arranged in a circular track, the code wheel being mounted to a top surface of the flange and being centered about the central bore in the hub to enable the code wheel to rotate with the shaft within the central bore.

14. The printer of claim 13, the hub having slits formed through the external wall and the internal wall for resilient gripping of a shaft within the central bore.

15. The printer of claim 14 further comprising:

a light source oriented to direct light in one direction;

a light sensor oriented to receive light from the light source, the light sensor being displaced from the light source so the masking pattern of the code wheel rotates about the central bore between the light source and the light sensor so the light sensor generates an electrical signal corresponding to the masking pattern selectively passing light from the light source to the light sensor as the code wheel rotates; and a cover that mates with the base to enclose the hub, code wheel, light source, and the light sensor to form a module for installation about a shaft extending from the longitudinal axis of the print drum of the printer.

* * * * *